United States Patent [19]

Pillis

[11] Patent Number: 4,515,540

[45] Date of Patent: May 7, 1985

[54] VARIABLE LIQUID REFRIGERANT INJECTION PORT LOCATOR FOR SCREW COMPRESSOR EQUIPPED WITH AUTOMATIC VARIABLE VOLUME RATIO

[75] Inventor: Joseph W. Pillis, Hagerstown, Md.

[73] Assignee: Frick Company, Waynesboro, Pa.

[21] Appl. No.: 554,477

[22] Filed: Nov. 22, 1983

[51] Int. Cl.[3] ..... F01C 21/06; F01C 1/16

[52] U.S. Cl. ..... 418/97; 418/201; 417/310

[58] Field of Search ..... 418/97, 99, 201; 417/310

[56] References Cited

U.S. PATENT DOCUMENTS

| | | | |
|---|---|---|---|
| 3,432,089 | 3/1969 | Schibbye | 230/138 |
| 3,738,780 | 6/1973 | Edstrom | 418/97 X |
| 3,795,117 | 3/1974 | Moody, Jr. et al. | 62/197 |
| 3,869,227 | 3/1975 | Kocher et al. | 418/15 |
| 3,874,828 | 4/1975 | Herschler et al. | 418/87 |
| 3,885,402 | 5/1975 | Moody et al. | 418/201 X |
| 3,913,346 | 10/1975 | Moody, Jr. et al. | 62/197 |
| 4,375,156 | 3/1983 | Shaw | 418/97 X |

*Primary Examiner*—Richard E. Gluck

*Attorney, Agent, or Firm*—Dowell & Dowell

[57] ABSTRACT

An automatic variable volume ratio screw compressor has a plurality of ports for the injection of liquid refrigerant into the interlobe volume. These ports communicate with the interlobe volume at different effective distances from the discharge port so that the injection of liquid refrigerant may be done at the latest possible time during compression for effective use of the refrigerant, and without risking exposure to the open discharge port.

The selection of the port is done automatically in response to the instantaneous internal volume ratio.

5 Claims, 5 Drawing Figures

OIL FROM LUBRICATION SYSTEM
POT. 1
POT. 2
P T
A B

INJ. INLET PORT 1
LOW VOLUME RATIO
INJ. INLET PORT 2
HIGH VOLUME RATIO
LIQ. REFRIG. IN
OIL VENT
OIL PRESS.
SOL. A
SOL. B
INLET
DISCHARGE
OUTPUT 5
OUTPUT 1
OUTPUT 2
OUTPUT 3
OUTPUT 4
DISPLAY
MICRO COMPUTER
PROGRAM
ANALOG INPUT MODULE ADC
DISCHARGE PRESSURE TRANSDUCER
SUCTION PRESSURE TRANSDUCER
MOTOR CURRENT TRANSDUCER
1-5 VDC
+DC
-DC

VARIABLE LIQUID REFRIGERANT INJECTION PORT LOCATOR FOR SCREW COMPRESSOR EQUIPPED WITH AUTOMATIC VARIABLE VOLUME RATIO

FIELD OF THE INVENTION

This invention relates to helical screw type compressors with axial fluid flow in which an automatically variable volume ratio is provided, and provision is made for injecting liquid refrigerant for cooling purposes into the interlobe volume.

DESCRIPTION OF THE PRIOR ART

The present invention is particularly adapted as an application to the invention described in application Ser. No. 416,768, filed Sept. 10, 1982, by David A. Murphy and Peter C. Spellar. Accordingly, the present inventor makes no claim of inventorship in the subject matter of that application. Its disclosure is used herein as an illustration of subject matter with which the present invention may be employed.

Reference is also made to application Ser. No. 453,988, filed Dec. 26, 1982, by David A. Murphy and Peter C. Spellar, which is referred to as a continuation-in-part of the aforesaid application Ser. No. 416,768.

The use of oil in screw compressors for sealing the gas leakage paths around the rotors, for lubricating the contact areas, and for removing heat from the gas as it is compressed, is known in the art. On all except low compression ratio systems some type of oil cooling is generally used to remove the heat of compression from the oil and gas so that the oil can be reinjected at the desired temperature.

One method that has been used for oil cooling is to inject liquid refrigerant into the interlobe volume of the screw threads prior to opening of the threads to the discharge port. This refrigerant expands from the condenser pressure through an expansion valve to a specific pressure in the screw thread. By adjusting the flow of refrigerant the discharge temperature from the compressor is controlled to the desired level.

The Schibbye U.S. Pat. No. 3,432,089 discloses the injection of lubricating oil through channels 114 into the compressor in which the point of injection varies with the percent of full load position of the slide valve, which provides capacity adjustment.

The Edstrom U.S. Pat. No. 3,738,780 appears to disclose the use of alternate oil injection port locations for different but fixed internal volume ratio compressors, by changing the slide valve and a plug under the machine.

The Moody et al. U.S. Pat. No. 3,795,117 discloses the use of liquid refrigerant injected to control discharge temperature from a screw compressor.

The Kocher et al. U.S. Pat. No. 3,869,227 appears to disclose varying the location of the high pressure suction port for changing machine capacity.

The Herschler et al. U.S. Pat. No. 3,874,828 discloses a screw compressor having a manually adjusted capacity control valve, operation of which not only varies the port location to control capacity, but also brings into registration cooling liquid injection ports, preferably for oil, of varying sizes so that the quantity of liquid varies in accordance with the capacity of the compressor.

The Moody et al. U.S. Pat. No. 3,885,402 discloses a compressor of fixed internal volume ratio in which provision is made for determining the optimum point of injection.

The Moody et al. U.S. Pat. No. 3,913,346 appears to be directed primarily to a screw compressor system for cooling a hermetic motor and a screw compressor with the same liquid.

The Shaw U.S. Pat. No. 4,375,156 discloses the use of liquid refrigerant for cooling a screw compressor.

SUMMARY OF THE INVENTION

The present invention is directed to the injection of liquid refrigerant into the interlobe volume of a variable volume ratio screw compressor at one of two or more locations spaced at different volume positions from the discharge point and means for automatically selecting the injection port in correspondence to the internal volume ratio at which the compressor is operating at that time.

This is accomplished by providing two or more liquid refrigerant inlet ports in the wall of the compressor adjacent to the discharge port, the inlet ports being spaced so that one of the inlet ports which is spaced further from the discharge than the other is uncovered first by the screw threads and that a control means responsive to the internal volume ratio operates a valve means to select the path of flow of liquid refrigerant to the desired inlet port.

DESCRIPTION OF THE SUBJECT MATTER OF APPLICATION SER. NO. 416,768

Figures 1, 2, 3:
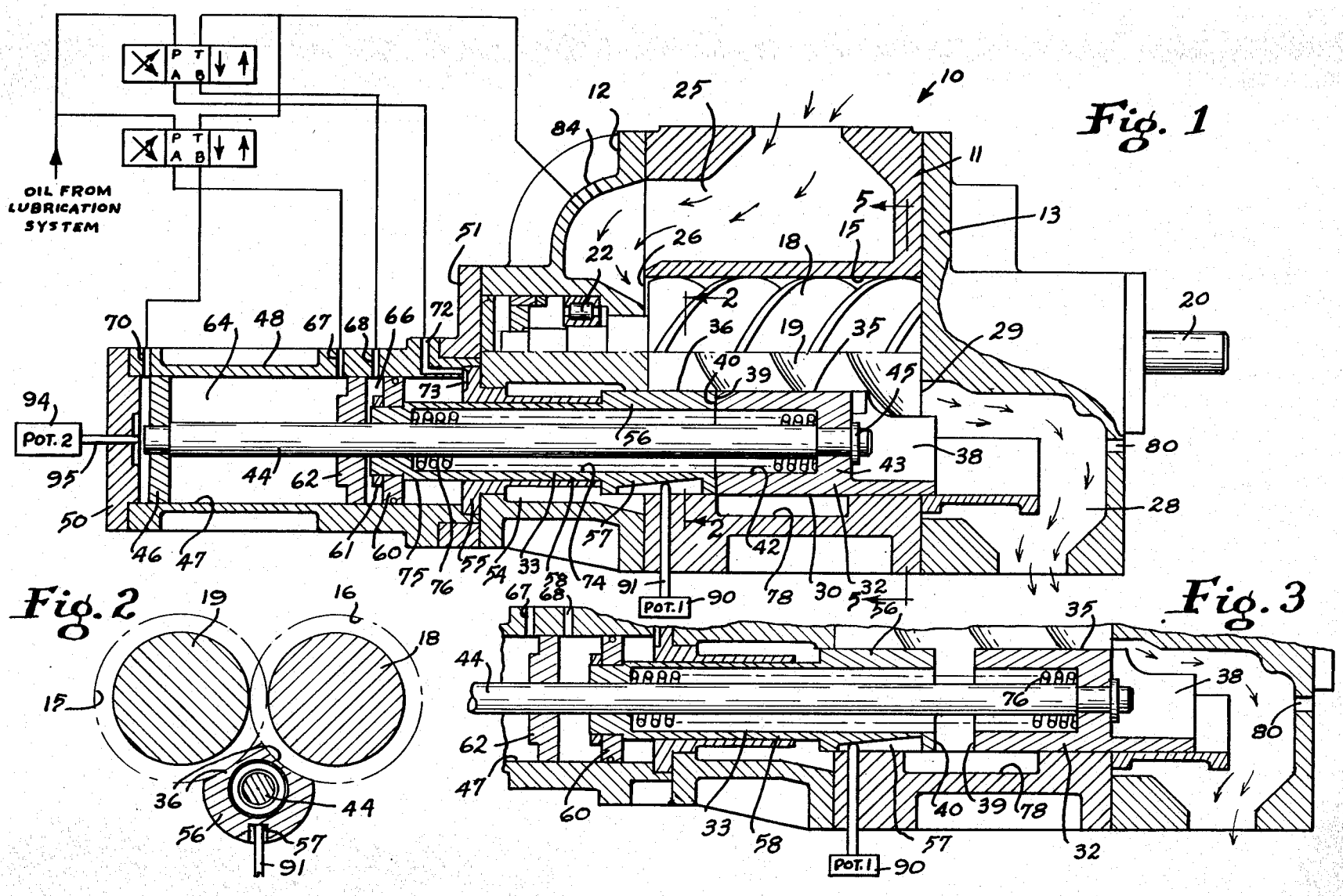
FIG. 1 is a horizontal sectional view of a screw type compressor as disclosed in the application referred to above, Ser. No. 416,769.
FIG. 2 is a sectional view of a portion of the compressor taken along line 2—2 of FIG. 1.
FIG. 3 is a view similar to FIG. 1 illustrating the slide valve and slide stop in positions differing from those of FIG. 1.

With further reference to the drawings a helical screw compressor 10 is illustrated having a central rotor casing 11, an inlet casing 12, and an outlet casing 13 connected together in sealing relationship. The rotor casing has intersecting bores 15 and 16 providing a working space for intermeshing male and female helical rotors or screws 18 and 19 mounted for rotation about their parallel axes by suitable bearings.

Rotor 18 is mounted for rotation on shaft 20 carried in a bearing (not shown) in outlet casing 13, and in bearing 22 carried in inlet casing 12. Shaft 20 extends outwardly from the outlet casing for connection to a motor (not shown) through a suitable coupling (not shown).

The compressor has an inlet passageway 25 in inlet casing 12 communicating with the working space by port 26. A discharge passageway 28 in outlet casing 13 communicates with the working space by port 29 (which is at least partially within the outlet casing 13).

It will be apparent in the illustrated embodiment that in a horizontally positioned machine inlet port 26 lies primarily above a horizontal plane passing through the axes of the rotors and outlet port 29 lies primarily below such plane.

Positioned centrally beneath the bores 15 and 16, and having a parallel axis, is a longitudinally extending, cylindrical recess 30 which communicates with both the inlet and outlet ports.

Mounted for slideable movement in recess 30 is a compound valve member including a slide valve 32 and cooperating member or slide stop 33. The innerface 35 of the slide valve, and the innerface 36 of the slide stop are in confronting relation with the outer peripheries of the rotors 18 and 19 within the rotor casing 11.

The right end of the slide valve (as viewed in FIG. 1) has an open portion 38 on its upper side providing a radial port communicating with the outlet port 29. The left end 39 may be flat or shaped as desired to fit against the right end 40 of the slide stop in order that engagement of the two adjacent ends of the slide valve and slide stop will seal the recess 30 from the bores 15 and 16.

The slide valve has an inner bore 42 and a head 43 at one end. A rod 44 is connected by fastening means 45 at one end to the head through which it extends and at its other end to a piston 46. The piston is mounted to reciprocate in the barrel 47 of cylinder 48 which is connected to and extends axially from the inlet casing 12. A cover or end plate 50 is mounted over the outer end of the cylinder 48. The inlet casing 12 is connected to the cylinder 48 by an inlet cover 51 which receives a reduced diameter end portion 52 of cylinder 48.

Mounted interiorly of the inlet cover 51 is a sleeve 54 having a bulkhead portion 55 at one end and extending longitudinally towards the rotor casing. The slide stop 33 has a head portion 56 terminating in the end 40 and the head portion has an inclined slot 57 on its underside sloping upwardly from left to right as viewed in the drawing. The axial length of the slot is adequate to permit the maximum desired movement of the slide stop. From the head portion the slide stop has a main portion 58 which is slideably received within the sleeve 54. At its other end the slide stop has a piston 60 secured by suitable fastening means 61.

A stationary bulkhead 62 is fixed in the cylinder 48 intermediate its ends and separates the interior into an outer compartment 64 in which piston 46 moves, and an inner compartment 66 in which piston 60 moves. Cylinder 48 has fluid ports 67 and 68 closely adjacent each side of the bulkhead 62 communicating with the compartments 64 and 66, respectively. At the outer end of cylinder 48 a fluid port 70 is provided in communication with the compartment 64 but on the opposite side of piston 46. At its inner end the cylinder 48 has port 72 communicating with recess 73 in the outer end face of the bulkhead portion 55 of the sleeve 54 for introducing and removing fluid from the compartment 66 but on the opposite side of piston 60 from the port 68.

The slide stop has an inner bore 74 of matching diameter to that of bore 42 in the slide valve 32 and communicating with that bore. At its other end the slide stop has a head 75 which mounts the piston 60.

A self-unloading coil spring 76 is positioned in the coaxial bores 74 and 42, around rod 44, and tends to urge the slide valve 32 to closed position and to urge the slide stop into abutting relating with the bulkhead 62. In such position the slide valve and slide stop are spaced apart a maximum distance.

In operation the working fluid, such as a refrigerant gas enters the compressor by inlet 25 and port 26 into the grooves of the rotors 18 and 19. Rotation of the rotors forms chevron shaped compression chambers which receive the gas and which progressively diminish in volume as the compression chambers move toward the inner face of the outlet casing 13. The fluid is discharged when the crests of the rotor lands defining the leading edge of a compression chamber pass the edge of port 38 which communicates with the discharge 28. Positioning of the slide valve 32 away from the outlet casing 13 reduces the compression ratio by enlarging the final compression chamber. Positioning towards the outlet casing, when the slide valve and slide stop are together, has the opposite effect. Thus, movement of the slide valve varies the compression ratio and the pressure of the gas discharged from the compressor.

The compressor is constructed to provide a controlled variation in its volumetric capacity simultaneously with controlling its compression ratio. Thus, as will be described, the slide valve and slide stop may be controlled to match the internal compression ratio in the compressor to the inlet and outlet compression ratio as the volumetric capacity is controlled. When the slide valve and slide stop are moved apart, as indicated in FIG. 3, the space therebetween communicates with the intermeshed rotors 18 and 19 to permit working fluid in a compression chamber between the rotors at inlet pressure to remain in communication with the inlet through slot 78 and a passageway (not shown) in casing 11 thereby decreasing the volume of fluid which is compressed. Thus, maximum capacity is provided with the slide valve and slide stop in abutting relation. The nearer the outlet casing the space between the slide valve and the slide stop is positioned, the greater the decrease in capacity from a maximum.

THE CONTROL SYSTEM

A control system is described for moving the slide valve and slide stop in accordance with a predetermined program to accomplish the aforestated objectives. In order to do this four variables from the compressor are constantly sensed and fed into an electrical network. Thus, outlet casing 13 has a plug opening 80 connected by conduit 81 to discharge pressure transducer 82. Inlet casing 12 has plug opening 84 connected by conduit 85 to suction pressure transducer 86. Potentiometer 90 has its movable element 91 extending through the wall of rotor casing 11 and engaged with the inclined slot 57 in the slide stop 33 and fuctioning as P1 to control voltage divider network 92. Potentiometer 94 has its movable element 95 extending through the cylinder cover 50 into engagement with rod 44 of slide valve 32 and fuctioning as P2 to control voltage divider network 96. The voltage divider network 92 includes calibration resistors R1 and R2 and transmits a 1–5 voltage DC signal to the analog input module 98 by lines 100 and 101. Similarly, voltage divider network 96 includes calibration resistors R3 and R4 and feeds a 1–5 DC signal to the analog input module 98 by lines 102 and 103.

The discharge pressure transducer 82 and suction pressure transducer 86 convert the signal each received to a 1–5 volt DC signal and sends it by lines 104–107 to analog input module 98.

Module 98 converts the signals it received to digital signals and transmits these to microcomputer 110. Microcomputer 110 has a program 112 of predetermined nature so that the computer output provides the desired control of the slide valve 32 and slide stop 33. An appropriate readout or display 114 is connected to the computer 110 to indicate the positions of the slide valve and the slide stop based on the signals received from the feedback potentiometers 90 and 94.

From the computer 110, four control signals are provided through the outputs 116, 117, 118 and 119. Thus, the two signals from the voltage divider networks 92 and 96, responsive to slide stop and slide valve position, and the two signals from the discharge and suction pressure transducers 82 and 86, are coupled through the analog input to the microcomputer and processed thereby to deliver appropriate outputs 116 through 119. Outputs 116 and 117 are connected to solenoids 120 and 121 through lines 122 and 123, respectively. Outputs 118 and 119 are connected to solenoids 125 and 126 through lines 127 and 128, respectively.

Solenoids 120 and 121 control hydraulic circuits through control valve 130 which position the slide stop 33. Solenoids 125 and 126 control hydraulic currents through control valve 131 which position the slide valve 32.

Control valve 130 is connected by line 134 to a source of oil or other suitable liquid under pressure from the pressurized lubrication system of the compressor. Line 135 connects the valve 130 to fluid port 72 and line 136 connects the valve to fluid port 68. A vent line 137 is connected to the inlet area of the compressor.

Control valve 131 is connected by line 134 to the oil pressure source and by line 137 to the vent. Line 138 connects valve 131 to fluid port 67 and line 139 connects valve 131 to fluid port 70.

In operation, energizing solenoid 120 of valve 130 positions the valve so that flow is in accordance with the schematic representation on the left side of the valve, the flow being from "P" to "B" and thus applying oil pressure via conduit 136 against the left side of piston 60 and simultaneously venting oil from the opposite side of the piston via conduit 135 and in the valve from "A" to "T" to the oil vent. This urges the piston and its associated slide stop to the right, as represented in the drawing.

Energizing solenoid 121 of valve 130 positions the valve so that flow is in accordance with the schematic representation on the right side of the valve, the flow being from "P" to "A" and thus applying oil pressure via conduit 135 against the right side of piston 60 to urge it to the left and simultaneously venting oil from the opposite side of the piston via conduit 136 and in the valve from "B" to "T" to the oil vent.

Similarly, energizing solenoid 125 of valve 131 positions that valve from "P" to "B" to apply pressure through fluid port 70 and venting through fluid port 67 from "A" to "T" to move the slide valve to the right as represented in the drawing. Energizing solenoid 126 of valve 131 positions the valve from "P" to "A" to apply pressure through fluid port 67 and venting through fluid port 70 from "B" to "T" to move the slide valve to the left.

When the compressor is used in a refrigeration system it is normally desired to move its slide valve to maintain a certain suction pressure which is commonly referred to as the "set point". Optionally, other parameters such as the temperature of the product being processed in a refrigeration system associated with the compressor, may be used as factors affecting the position of the slide valve and, hence, the capacity of the compressor. The system contemplates entering a desired set point into the microcomputer 110 by appropriate switches connected with a control panel, not shown, associated with the display 114. The control panel may also include provision for controlling the mode of operation, e.g., automatic or manual, and the operation of the slide stop, slide valve, and compressor. The readout display 114 from the microcomputer 110 is based on the signals it receives. The necessary electrical connections are made between the control panel and the microcomputer 110 in order to accomplish the desired function by means well known in the art.

The program associated with the microcomputer 119 is such that it will select the proper position for the slide stop 33 based upon the information received from the discharge pressure transducer 82 and the suction pressure transducer 86, and the characteristics of the refrigerant and the compressor. The program is prepared so that it will control the position of the slide valve 32 based upon the suction pressure transducer 86 or other appropriate capacity indication.

Thus, the control system contemplates constantly sensing the four variables, discharge and suction pressure, and the positions of the slide stop and slide valve, and, if necessary, moving the slide stop and slide valve in the appropriate direction until the signals received by the microcomputer 110 are in balance with the position of the slide stop established by the program 112 and the slide valve.

In order to avoid excessive current to the motor driving the compressor, in systems using an electric motor, a motor current transducer 140 is connected to such motor, not shown. The transducer 140 is connected by lines 141 and 142 to the analog input module 98, connected to the microcomputer 110. Microcomputer 110 is so programmed that it will not permit the slide valve 32 to load the compressor to the point that the motor current exceeds a predetermined limit, and will unload the slide valve 32 if the motor current exceeds a higher limit.

The slide valve 32 operates as a floating type of control. It is moved in the direction of loading or unloading in response to a capacity control signal, e.g., derived from the suction pressure transducer 86, but it is not positioned to any precise location relative to any other signal or control. While the capacity control signal is usually based on the suction pressure, it may include other parameters such as the product temperature, as stated above. The outputs from loading and unloading are normally pulsed in a time proportioned arrangement to vary the rate of response of the slide valve with the magnitude of the error of the capacity control signal.

The signal from the potentiometer 90 associated with the slide valve is not used to control its position. However, it is used to indicate its position and such position is used for other purposes including starting the compressor fully unloaded, and where applicable, in multicompressor sequencing.

In contrast the slide stop is controlled to a precise location, as stated above. The feedback from its potentiometer 94 is used to determine when it is in the desired position.

The feedbacks from the potentiometers for both the slide stop and slide valve are used to determine whether a conflict or overlapping exists between the desired mechanical position of the slide stop and the actual mechanical position of the slide valve. If a conflict exists, the slide valve is temporarily relocated so that the positioning of the slide stop takes precedence.

The system also has provision whereby appropriate controls indicated on the control panel may be operated to permit manual positioning of both the slide valve and the slide stop.

Positioning of the slide valve and slide stop with reference to the rotor casing and to each other permits the desired variations in the compression ratio so that the compressor may be "loaded" or "unloaded" as required by various parameters.

While hydraulic means has been described for moving the slide stop and slide valve, other means well known to those skilled in the art may be used. For example, electric stepper motors or stepper motor piloted hydraulic means may be used if desired.

DESCRIPTION OF A PREFERRED EMBODIMENT OF THE INVENTION

As mentioned above the present invention may be applied to the subject matter of application, Ser. No. 416,768 described above.

Figures 4, 5:
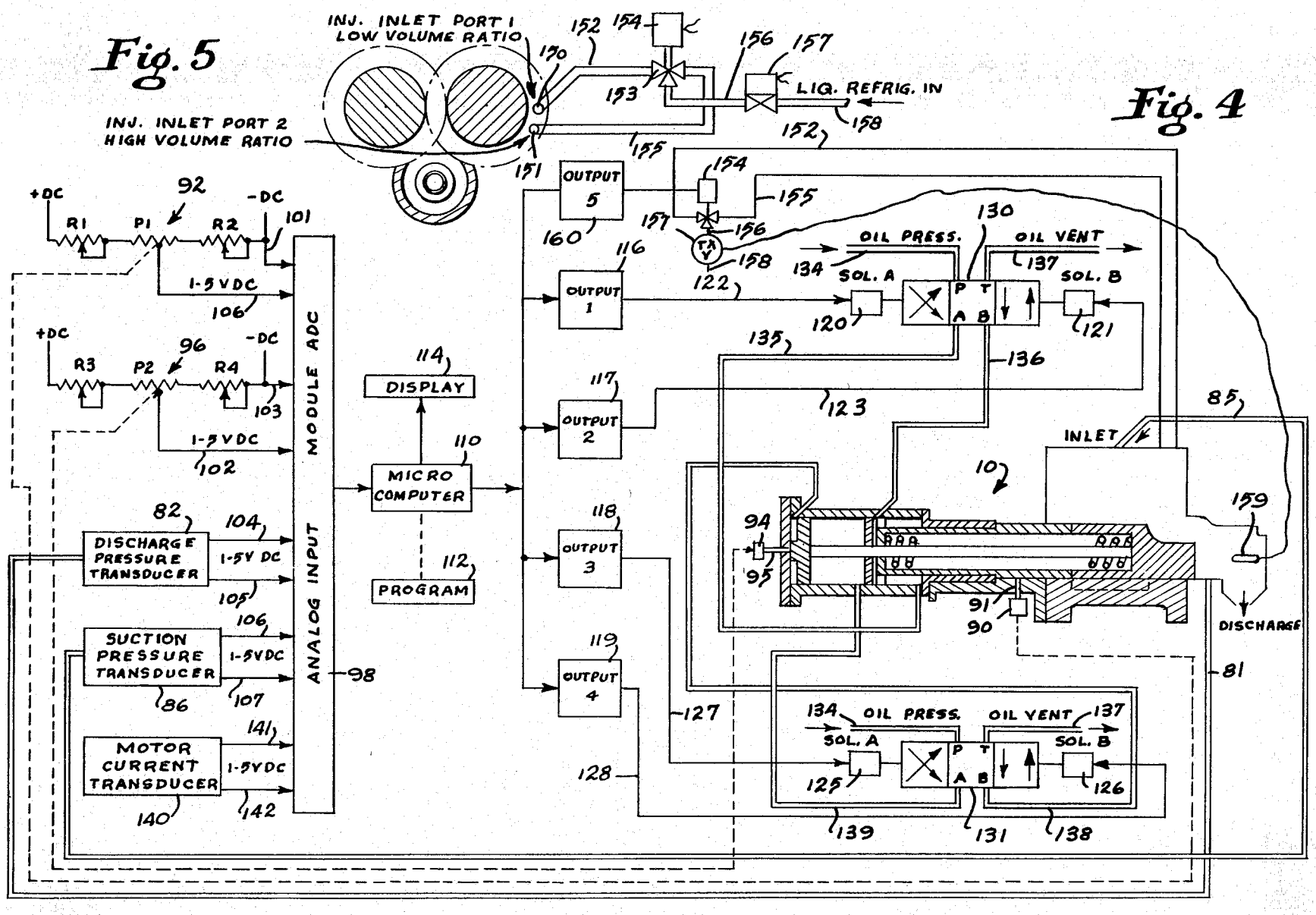
FIG. 4 is a schematic view including the control circuitry and includes the drawing of FIG. 4, from the aforesaid application Ser. No. 416,768, modified by the addition of control elements in accordance with the present invention.
FIG. 5 is a sectional view, at a reduced scale, of the ports of the compressor taken on line 5—5 of FIG. 1, in accordance with the present invention.

With further reference to FIG. 5, the compressor central rotor casing 11 has in its side wall, in spaced relation from the end wall of the outlet casing 13, a pair of ports 150 and 151. Port 150 is located so that it communicates with the threads of an interlobe volume prior to the communication therewith of port 151. It will thus be understood that the interlobe volume is larger when port 150 is initially exposed to it than when port 151 is first exposed thereto. Accordingly, when the internal volume ratio is relatively low, port 150 would be open whereas when a higher volume ratio is used port 150 would be closed and port 151 would be open. Various locations in either side wall or the end wall may be employed for the ports 150 and 151.

Inlet port 150 is connected by line 152 to valve 153 operated by solenoid 154. Similarly, inlet valve 151 is connected by line 155 to valve 153. Valve 153 is connected by liquid refrigerant line 156 through thermal expansion valve 157 to a line 158 providing a source of liquid refrigerant.

In order to control solenoid 154 the system as illustrated in FIG. 4 may be employed. As described above the system of FIG. 4 includes a schematic of the cross section of a helical screw type compressor having dual slides for volume ratio and capacity control. In order to introduce liquid refrigerant into the compression area of the screw compressor prior to discharge of the compressed vapors the present invention is employed.

In order to accomplish the control of the introduction of liquid refrigerant, a fifth output 160, from the microcomputer is provided which is connected to control the operation of the solenoid 154 as indicated on the drawing. Thus, as the machine changes from one internal volume ratio to another the flow of liquid refrigerant is diverted from one inlet port to the other by means of valve 153 controlled by the solenoid 154 which is in turn controlled from the output 160. The output 160 serves to energize or deenergize the solenoid 154 to cause refrigerant to enter the compressor housing through either inlet port 150 or 151. The liquid supply is controlled by the thermal expansion valve 157 which senses the discharge temperature in the discharge conduit 28 by means of sensor 159.

Accordingly, it will be understood that on a compressor of fixed built-in volume ratio, as for example in Moody et al. U.S. Pat. No. 3,885,402, the internal port location and size may be chosen to provide the best specific performance at the compressor's operating internal volume ratio. For example, on a compressor of low internal volume ratio the port is located nearer the beginning of compression than on a machine designed to run at higher built-in internal volume ratios. As a result the power required to recompress this refrigerant can be reduced and overall compressor efficiency increased.

On a screw compressor having a variable volume ratio the location of the ports at various optimum locations for various internal volume ratios in the range of the compressor is provided. As the machine changes from one internal volume ratio to another the flow of liquid refrigerant is diverted from one internal port to another by means of the condition responsive operated valves. Thus, when the internal volume ratio is low the injection is at a point farther from the discharge than it is for a higher internal volume ratio.

While the illustrated embodiment of the invention discloses two port locations, more than two may be used if the range of volume ratios should so require.

Thus, the structure and operation provides for attaining a constant discharge temperature from the compressor, as may be desired, while minimizing efficiency losses.

I claim:

1. In a screw compressor having meshing helical rotors on parallel axes and mounted in a housing having intersecting cylindrical bores, whereby the rotors and housing provide an interlobe volume which varies with the rotation of the rotors, said housing having a high pressure end wall at one end of said housing and a low pressure end wall at the other end thereof, the low pressure end wall having an inlet opening for the inlet of the compressor and the high pressure end wall having a discharge opening for the outlet of the compressor, means for varying the internal volume ratio of said compressor, first and second ports in said housing, said ports being located in said housing for exposure to the interlobe volume at selected positions of the rotors, said first port being located so that the interlobe volume is relatively large when the interlobe volume is first exposed to it, and said second port being located so that the interlobe volume is relatively small when the interlobe volume is first exposed to it, whereby the interlobe volume varies when said rotors initially communicate with either of said ports, and means for selectively introducing liquid refrigerant into one or the other of said ports.

2. The invention of claim 1 in which the means for varying the internal volume ratio operates automatically in response to one or more operating conditions of the compressor.

3. The invention of claim 2, and means responsive to the internal volume ratio for controlling the means for selectively introducing liquid refrigerant to said ports.

4. The invention of claim 3, in which said means for selectively introducing liquid refrigerant into one or the other of said ports is a valve means, and electric means operating said valve means.

5. In a screw compressor having meshing helical rotors on parallel axes and mounted in a housing having intersecting cylindrical bores, whereby the rotors and housing provide an interlobe volume which varies with the rotation of the rotors, said housing having a high pressure end wall at one end of said housing and a low pressure end wall at the other end thereof, the low pressure end wall having an inlet opening for the inlet of the compressor and the high pressure end wall having a discharge opening for the outlet of the compressor, and axially extending recess means in the housing in open communication with said bores, means for varying the internal volume ratio of said compressor, said means including a slide valve member mounted for axial movement in the recess means, said slide valve member having an inner face in sealing relationship with said rotors, said slide valve member having a discharge face at one end thereof which is adjacent to the high pressure end wall and having a rear face at its other end, and a slide stop member mounted for axial movement in said recess means, said slide stop member having an inner face in sealing relationship with said rotors, said slide stop member having a front face, the slide stop front face being adapted to engage the slide valve member rear face to form a continuous composite member which is selectively operative to close the axially extending recess means to the inlet opening, said slide valve member and said slide stop being movable apart to provide an opening therebetween of variable selected size and axial position in communication with the inlet opening, the improvement comprising first and second ports in said housing, said ports being located in said housing for exposure to the interlobe volume at selected positions of the rotors, said first port being located so that the interlobe volume is relatively large when the interlobe volume is first exposed to it, and said second port being located so that the interlobe volume is relatively small when the interlobe volume is first exposed to it, whereby the interlobe volume varies when said rotors initially communicate with either of said ports, and means for selectively introducing liquid refrigerant into one or the other of said ports.

* * * * *